US005470687A

United States Patent [19]

Mayama et al.

[11] Patent Number: 5,470,687

[45] Date of Patent: Nov. 28, 1995

[54] PROCESS FOR PRODUCING TONER PARTICLES USING FREE SPACE FORMED IN A POLYMERIC MEDIUM

[75] Inventors: Shinya Mayama, Yamato; Takeshi Ikeda; Yoshinobu Baba, both of Yokohama; Naoya Ogata, Tokyo, all of Japan

[73] Assignee: Canon Kabushiki Kaisha, Tokyo, Japan

[21] Appl. No.: 233,324

[22] Filed: Apr. 26, 1994

[30] Foreign Application Priority Data

Apr. 28, 1993 [JP] Japan ..... 5-123153

[51] Int. Cl.[6] ..... G03G 9/00

[52] U.S. Cl. ..... 430/137; 430/111

[58] Field of Search ..... 430/137, 111

[56] References Cited

U.S. PATENT DOCUMENTS

| | | | |
|---|---|---|---|
| 2,297,691 | 10/1942 | Carlson . | |
| 3,634,251 | 1/1972 | Maeda et al. | 252/62.1 |
| 4,071,670 | 1/1978 | Vanzo et al. | 526/88 |
| 4,777,104 | 10/1988 | Matsumoto et al. | 430/109 |
| 4,816,366 | 3/1989 | Hyosu et al. | 430/137 |
| 5,015,551 | 5/1991 | Tachikawa et al. | 430/137 |

FOREIGN PATENT DOCUMENTS

| | | | |
|---|---|---|---|
| 0203818 | 12/1986 | European Pat. Off. . | |
| 0330498 | 8/1989 | European Pat. Off. . | |
| 0390527 | 10/1990 | European Pat. Off. . | |
| 0466212 | 1/1992 | European Pat. Off. . | |
| 36-10231 | 7/1961 | Japan . | |
| 51-14895 | 5/1976 | Japan . | |
| 53-17737 | 2/1978 | Japan . | |
| 53-17736 | 2/1978 | Japan . | |
| 53-17735 | 2/1978 | Japan . | |
| 1583564 | 1/1981 | United Kingdom | G03G 9/08 |
| 1583411 | 1/1981 | United Kingdom | G03G 9/08 |

OTHER PUBLICATIONS

Database WPI, Week 9302, Derwent Publ., AN-93-012422, based on JP 4-338974.

*Primary Examiner*—Christopher D. Rodee

*Attorney, Agent, or Firm*—Fitzpatrick, Cella, Harper & Scinto

[57] ABSTRACT

A toner for developing electrostatic images is comprised of toner particles having a number average particle diameter of from 0.5 μm to 5.0 μm, in which toner particles with a particle diameter of 6.0 μm or larger is included in a proportion of not more than 5% by number. The toner particles are obtained by a process having the steps of dispersing a monomer composition containing at least a colorant, a charge control agent, or a mixture of these, and a polymerizable monomer, in free space formed in a polymeric medium, and polymerizing the monomer composition dispersed in said free space.

7 Claims, 2 Drawing Sheets

PROCESS FOR PRODUCING TONER PARTICLES USING FREE SPACE FORMED IN A POLYMERIC MEDIUM

BACKGROUND OF THE INVENTION

1. Field of the Invention

This invention relates to a toner used in a process by which an electrostatic latent image is converted to a visible image, in particular, a toner that can provide electrophotographic images reproduced in a high image quality and a high resolution, a one-component type developer or two-component type developer making use of such a toner, and a process for producing toner particles.

2. Related Background Art

There is an image forming method in which an electrical or magnetic latent image formed on a recording member is converted to a visible image by attracting to the latent image, electrosensitive or magnetosensitive fine particles called a toner. As electrophotography, which is a typical example thereof, a large number of methods are known in the art as disclosed, for example, in U.S. Pat. No. 2,297,691. In general, in this electrophotography, an electrostatic latent image is formed on a photosensitive member, utilizing a photoconductive material and according to various means, and subsequently the latent image is developed using the toner to form a toner image. The toner image is transferred to a transfer medium such as paper if necessary, and then the toner image thus transferred is fixed to the transfer medium by heating, pressing or using solvent vapor. A copy is thus obtained.

In recent years, people have shown interest in the improvement of image quality of electrophotographic reproductions, and hence it is sought to provide an electrophotographic process that can obtain high-grade copies with ease. Toner is formed of fine particles mainly composed of a resin and a coloring material such as a magnetic material, carbon black or a dye or pigment, which usually have a particle diameter in the range of 6 to 30 μm. In the formation of electrophotographic images, various processes are used to form the images, and are known to have influence on their image quality. In general, an improvement in image characteristics, specifically, in image reproducibility such as highlight reproducibility or shadow reproducibility, can bring about an improvement in image quality of electrophotographic images. For such purpose, it is considered necessary to use a toner with a small particle diameter, what is called small sized toner, as the above toner.

Toners have been hitherto commonly obtained by mixing and melting in a thermoplastic resin a coloring material comprised of a dye or pigment and a magnetic material to uniformly disperse the coloring material, followed by pulverization and classification to produce a toner having a desired particle diameter. This method is relatively stable as a technique and can enjoy relatively easy control of the materials and processes. In this method, however, contents are laid bare at shear cross-sections, and hence low-melting components (which make a melting point low) and release components (which impart releasability) can not be incorporated in large quantities enough for them to be effective. In addition, the classification must be carried out at a severe level in order to achieve the small particle diameter, resulting in an extremely low yield and an impractical industrial application.

In recent years, methods for producing toners by polymerization are proposed as methods to overcome the above disadvantages. These are disclosed in Japanese Patent Publications No. 36-10231 and No. 51-14895 and Japanese Patent Applications Laid-open No. 53-17735, No. 53-17736 and No. 53-17737. In the methods disclosed therein, a binder resin, a colorant such as a dye or a pigment, materials that are required to be contained in a toner as exemplified by a magnetic material, carbon black, a charge control agent and a release agent such as wax or silicone oil are dissolved or dispersed in polymerizable monomers optionally together with a polymerization initiator and a dispersant to form a polymerizable composition, and this polymerizable composition is dispersed in an aqueous continuous phase containing a dispersion stabilizer, using a dispersion machine, to form a dispersion of fine particles, followed by polymerization of this dispersion to effect its solidification so that toner particles with the desired particle diameters and composition can be obtained.

The above methods certainly enable omission of the steps of pulverization and classification and are expected to be effective for energy saving, improvement in process yield and cost reduction. However, products obtained may often have a particle size distribution which is varied according to production conditions such as stirring conditions and a production scale to yield a relatively broad particle size distribution. Further, it has been difficult to make toner particles stable to have a desired particle diameter required for obtaining images reproduced in a high quality and a high resolution.

SUMMARY OF THE INVENTION

An object of the present invention is to provide a toner for developing electrostatic images that has solved the problems discussed above, a one-component type developer or two-component type developer making use of such a toner, and a process for producing toner particles.

Namely, an object of the present invention is to provide a small-sized toner that can form images with a high resolution and a high quality, and a one-component type developer or two-component type developer making use of such a toner.

Another object of the present invention is to provide a process for producing toner particles, that can produce a small-sized toner having a desired small particle diameter, in a stable particle size distribution and a high productivity.

The present invention provides a toner for developing electrostatic images, comprising toner particles;

said toner particles having a number average particle diameter of from 0.5 μm to 5.0 μm, and containing toner particles with a particle diameter of 6.0 μm or larger in a proportion of not more than 5% by number.

The present invention also provides a one-component type developer comprising a toner having toner particles;

said toner particles having a number average particle diameter of from 0.5 μm to 5.0 μm, and containing toner particles with a particle diameter of 6.0 μm or larger in a proportion of not more than 5% by number.

The present invention still also provides a two-component type developer comprising a toner having toner particles, and a carrier;

said toner particles having a number average particle diameter of from 0.5 μm to 5.0 μm, and containing toner particles with a particle diameter of 6.0 μm or larger in a proportion of not more than 5% by number.

The present invention further provides a process for producing toner particles, comprising the steps of;

dispersing a monomer composition containing at least a colorant, a charge control agent, or a mixture of these, and a polymerizable monomer, in free space formed in a polymeric medium; and polymerizing the monomer composition dispersed in said free space to obtain toner particles.

DESCRIPTION OF THE PREFERRED EMBODIMENTS

Figure 1:
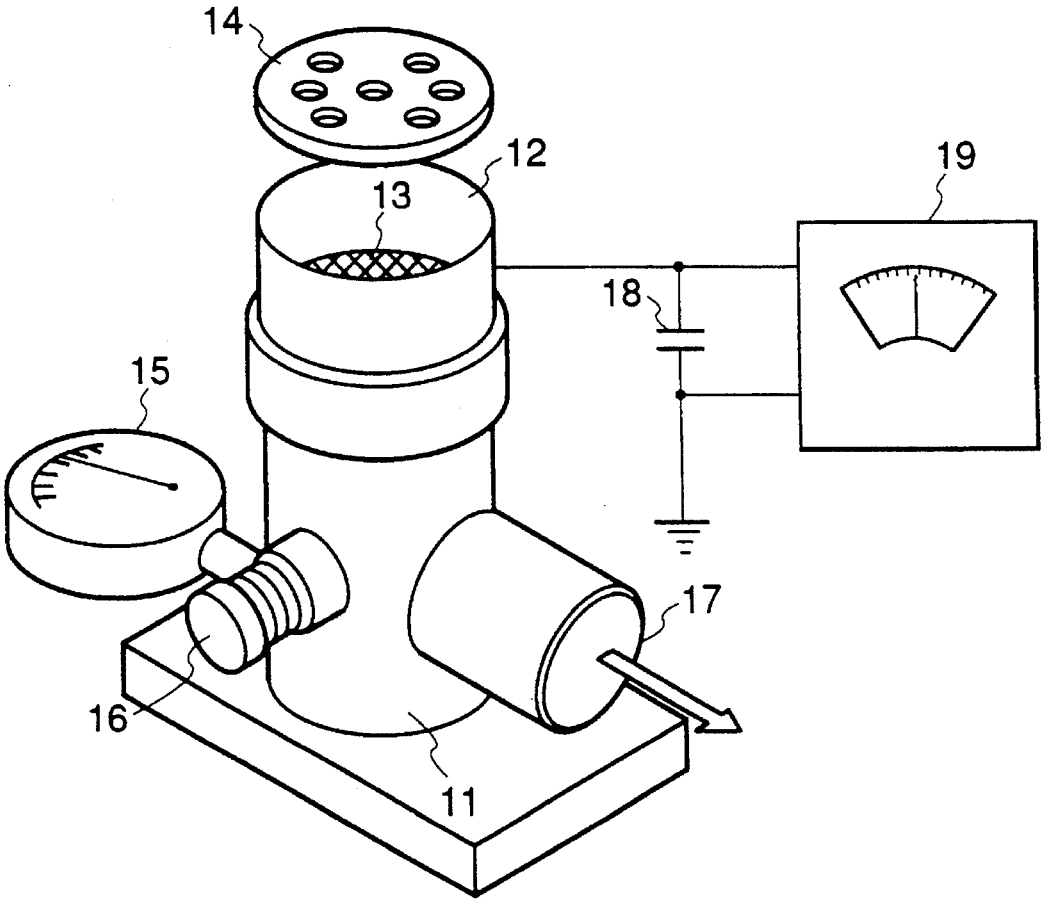
FIG. 1 illustrates a measuring device used to measure the quantity of triboelectricity in the present invention.

As a result of extensive studies, the present inventors have discovered that a toner having a narrow particle size distribution and a particle diameter controlled on a scale of submicrons, compared with conventional toners, can be formed when a monomer composition containing polymerizable monomers is subjected to polymerization in a specific polymeric medium. The above polymeric medium specifically refers to a mixture obtained by dissolving a polymer in a solvent. Usually, when a polymer is dissolved in a specific solvent, the solvent in which the polymer is dissolved and a polymeric compound interact and free space or voids of a specific extent are formed between polymer chains. Such free spaces can be arbitrarily controlled by changing the type of polymers, the molecular weight, the concentration and the type of solvents, and also the free spaces have a volume fairly uniformly distributed. Thus, it is presumed that inclusion of a polymerizable monomer composition into the free space makes the free spaces exhibit a certain cage effect and hence ultrafine polymer particles with the desired particle diameter can be formed in a good efficiency.

Toner particles produced by this method have a small average particle diameter and also a sharp particle size distribution. Hence, in the present invention, the toner particles obtained by controlling production conditions in the above particular production process have a number average particle diameter of from 0.5 μm to 5.0 μm, and contain toner particles with a particle diameter of 6.0 μm or larger in a proportion of not more than 5% by number. This makes it possible to form images with a high resolution and a high image quality.

Moreover, according to the present invention, the polymerization taking place in a polymeric matrix that forms the free spaces between polymer chains, defined by the mutual action of a polymeric compound and a reaction solvent in the polymeric medium does not cause any contamination due to the polymeric matrix, so that a toner formed of ultrafine polymer particles having very good charge characteristics can be produced.

As the polymeric compound used as the polymeric matrix stated above, various compounds can be used, specifically including, for example, polystyrene, polymethyl methacrylate, phenol novolak resins, cresol novolak resins, a styrene/acrylate copolymer, vinyl ether copolymers as exemplified by polymethyl vinyl ether, polyethyl vinyl ether, polybutyl vinyl ether and polyisobutyl vinyl ether, polyvinyl alcohol, polyvinyl acetate, a styrene/butadiene copolymer, an ethylene/vinyl acetate copolymer, polyvinyl chloride, polyvinyl acetal, cellulose, cellulose acetate, cellulose nitrate, alkylated celluloses, hydroxyalkylated celluloses as exemplified by hydroxymethyl cellulose and hydroxypropyl cellulose, saturated alkylpolyester resins, aromatic polyester resins, polyamide resins, polyacetals, polycarbonate resins, or mixtures of any of these, and preferably those capable of dissolving well in the reaction solvent and having no affinity for polymeric compounds produced.

These polymeric compounds may preferably have a weight average molecular weight of from 3,000 to 150,000, and more preferably from 8,000 to 80,000. Such compounds can contribute a uniform toner particle size distribution.

As the reaction solvent for dissolving the above polymeric compound, those in which the polymer produced as the polymerization of the polymerizable monomer proceeds can be deposited are used. The solvent may specifically include straight-chain or branched aliphatic alcohols such as methanol, ethanol, 1-propanol, 2-propanol, 1-butanol, 2-butanol, isobutyl alcohol, tertiary butyl alcohol, 1-pentanol, 2-pentanol, 3-pentanol, 2-methyl-1-butanol, isopentyl alcohol, tertiary pentyl alcohol, 1-hexanol, 2-methyl-1-pentanol, 4-methyl-2-pentanol, 2-ethylbutanol, 1-heptanol, 2-heptanol, 3-heptanol, 2-octanol and 2-ethyl-1-hexanol; and aliphatic hydrocarbons such as pentane, 2-methylbutane, n-hexane, cyclohexane, 2-methylpentane, 2,2-dimethylbutane, 2,3-dimethylbutane, heptane, n-octane, isooctane, 2,2,3-trimethylpentane, nonane, decane, cyclopentane, methylcyclopentane, ethylcyclohexane, p-menthane and bicyclohexyl; as well as aromatic hydrocarbons, halogenated hydrocarbons, ethers, fatty acids, esters and sulfur-containing compounds. Of the reaction solvents set out above, use of a lower alcohol and,an aliphatic hydrocarbon in combination is preferred from the viewpoint of reaction control.

The polymerizable monomers usable in the present invention may include styrene monomers such as styrene, o-methylstyrene, m-methylstyrene, p-methoxylstyrene, p-ethylstyrene and p-tertiarybutylstyrene; acrylic acid and acrylates such as methyl acrylate, ethyl acrylate, n-butyl acrylate, n-propyl acrylate, isobutyl acrylate, octyl acrylate, dodecyl acrylate, 2-ethylhexyl acrylate, stearyl acrylate, 2-chloroethyl acrylate and phenyl acrylate; methacrylic acid and methacrylates such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; 2-hydroxyethyl acrylate, 2-hydroxyethyl methacrylate, acrylonitrile, methacrylonitrile and acrylamide; vinyl derivatives as specifically exemplified by alkyl vinyl ethers such as methyl vinyl ether, ethyl vinyl ether, propyl vinyl ether, n-butyl ether and isobutyl ether, β-chloroethyl vinyl ether, phenyl vinyl ether, p-methyl phenyl ether, p-chlorophenyl ether, p-bromophenyl ether, p-nitrophenyl vinyl ether, p-methoxyphenyl vinyl ether, 2-vinylpyridine, 3-vinylpyridine, 4-vinylpyridine, N-vinylpyrrolidone, 2-vinylimidazole, N-methyl-2-vinylimidazole and N-vinylimidazole; and diene compounds such as butadiene.

Any of these monomers may be used alone or in the form of a mixture. Preferable polymer composition can be selected so that preferable performances can be obtained. Such a polymerizable monomer composition, usable in the present invention, may be a composition that becomes insoluble in the solvent used, as the polymerization proceeds.

The colorant that can be added in the monomer composition described above may specifically include carbon black, as well as organic colorants as specifically exemplified by dyes such as C.I. Direct Red 1, C.I. Basic Red 1, C.I. Mordant Red 30, C.I. Direct Blue 1, C.I. Direct Blue 2, C.I. Acid Blue 15, C.I. Basic Blue 3, C.I. Basic Blue 5, C.I. Mordant Blue 7, C.I. Direct Green 6, C.I. Basic Green 4 and C.I. Basic Green 6, and pigments such as cadmium yellow, mineral first yellow, naval yellow, Naphthol Yellow S, Hansa Yellow G, Permanent Yellow NCG, Tartrazine Lake, molybdenum orange GTR, Benzidine Orange G, cadmium red 4R, Watchung Red calcium salt, Brilliant Carmine 3B, Fast Violet B, Methyl Violet Lake, cobalt blue, Alkali Blue Lake, Victoria Blue Lake, quinacridone, Rhodamine Lake, Phthalocyanine Blue, Fast Sky Blue, Pigment Green B, Malachite Green Lake and Fanal Yellow Green.

In the present invention, a magnetic material may also be used as a colorant to obtain a magnetic toner.

The ultrafine polymer particles formed by using the above method and polymer may be further simultaneously incorporated with various additives so that any preferable developing performance can be imparted. The polymerization may be thus carried out to provide ultrafine polymer particles.

As the additives, a charge control agent may be added in the toner for the purpose of controlling the chargeability of the toner formed of ultrafine polymer particles. As the charge control agent, either a positive charge control agent or a negative charge control agent may be used, specifically including, for example, Nigrosine dyes, triphenylmethane dyes, quaternary ammonium salts, amine type compounds, imine type compounds, metal compounds of salicylic acid, metal compounds of alkylsalicylic acids, metal-containing monoazo dye compounds, polymers having a carboxylic acid functional group, polymers having a sulfonic acid functional group, and fumic acids such as nitrofumic acid and salts thereof.

As a polymerization initiator used in the present invention, any compounds can be used. Such a polymerization initiator may include azo or diazo type polymerization initiators such as 2,2'-azobis-(2,4-dimethylvaleronitrile), 2,2'-azobisisobutyronitrile, 1,1'-azobis-(cyclohexane-l-carbonitrile) and 2,2'-azobis-4-methoxy-2,4-dimethylvaleronitrile; and peroxide type polymerization initiators such as benzoyl peroxide, methyl ethyl ketone peroxide, diisopropylperoxy carbonate, cumene hydroperoxide, 2,4-dichlorobenzoyl peroxide and lauroyl peroxide.

In the present invention, a known chain transfer agent and a known dispersion stabilizer may be further added.

The ultrafine polymer particles of the present invention can be obtained by polymerization carried out in the presence of the reaction solvent, the polymeric matrix, the polymerizable monomer, the colorant, the charge control agent and any desired additive(s) such as wax. More preferably, they may be obtained by first dissolving the above polymeric matrix in the reaction solvent, and thereafter dissolving the polymerizable monomer, the colorant, the charge control agent and the polymerization initiator in the resulting solution of the polymeric matrix to initiate the polymerization.

For the polymeric matrix used in the present invention, its concentration can usually be adjusted so that preferable conditions can be appropriately provided according to the viscosity and concentration of the reaction system. It may preferably be used in a concentration ranging from 1% by weight to 50% by weight based on the weight of the reaction solvent used.

As for the polymerization initiator used when the ultrafine polymer particles of the present invention are obtained, its concentration can be appropriately adjusted taking account of the molecular weight, yield and so forth of the ultrafine particles to be produced. It may preferably be used in a concentration ranging from 0.1% by weight to 10% by weight, and more preferably from 0.5% by weight to 7% by weight, of the total weight of the polymerizable monomers used.

The colorant should preferably be used in an amount of from 0.1% by weight to 20% by weight, and more preferably from 0.5% by weight to 10% by weight, based on the binder resin component formed from the polymerizable monomers.

As the polymerization proceeds, the ultrafine polymer particles are formed and the reaction system gradually becomes turbid. The toner particles obtained are repeatedly washed with the reaction solvent or other suitable solvent. At this time, a separation means such as a centrifugal separator may be used in order to improve washing efficiency. After the washing, the toner particles obtained may be separated by filtration and then dried to obtain the desired toner. At this time, spraying such as spray drying may also be used as means for the separation and drying.

The toner particles obtained by the process of the present invention have a particle diameter ranging from 0.5 to 5 μm, and preferably from 0.5 to 4.0 μm, as number average particle diameter. Such particle diameter is suitable particularly for achieving the intended high image quality and high resolution of electrostatic images, and can be controlled by appropriately changing the type, concentration and molecular weight of the polymeric matrix.

The toner particles of the present invention contain toner particles with a particle diameter of 6.0 μm of larger in a proportion of not more than 5% by number, preferably not more than 3% by number, more preferably not more than 1% by number, and still more preferably 0% by number as its lower limit.

The toner particles of the present invention may also contain toner particles with a particle diameter of 0.3 μm or smaller in a proportion of not more than 15% by number, preferably not more than 12% by number, more preferably not more than 10% by number, and still more preferably 0% by number as its lower limit.

If the toner particles have a number average particle diameter smaller than 0.5 μm, it is difficult to impart an appropriate quantity of triboelectricity, and if they have a number average particle diameter larger than 5.0 μm, it becomes difficult to achieve the high image quality as intended in the present invention.

If the toner particles contain toner particles with a particle diameter of 6.0 μm or larger in a proportion more than 5% by number, gradation reproducibility of 600-line images may become extremely poor.

If the toner particles contain toner particles with a particle diameter of 0.3 μm or smaller in a proportion more than 15% by number, fogging may seriously occur to cause a great deterioration of image contrast.

In the present invention, the number average particle diameter is used as the particle diameter of the toner particles. It is measured by microscopy. More specifically, toner particles are magnified 10,000 times on an electron microscope, and a photograph of their image is taken. Thereafter, horizontal maximum chord lengths of 300 toner particles are actually measured and their number average is calculated. The above process may be carried out using an image analyzer or the like. Such an image analyzer can be specifically exemplified by LUZEX IV (trade name; Nireco Co.).

The resin component of the toner particles produced by the production process according to the present invention may have a number average molecular weight ranging from 3,000 to 1,000,000.

If the resin component of the toner particles has a number average molecular weight smaller than 3,000, the toner may have a poor thermal storage stability (anti-blocking properties). If the resin component has a number average molecular weight larger than 1,000,000, it may cause an extremely low fixing performance.

In the toner of the present invention, a low-temperature fluidizing component such as a plasticizer, liquid rubber, silicone oil or wax may be added so that its fixing properties at low temperature can be improved, or its release properties can be improved when applied in a heat-roll fixing assembly.

The wax may include, for example, paraffin waxes, polyolefin waxes, and modified products of these as exemplified by their oxides or grafted products, as well as higher fatty acids and metal salts thereof, higher aliphatic alcohols, higher aliphatic esters and aliphatic amide waxes. Any of these waxes may preferably be those having a softening point ranging from 30° to 130° C. as measured by the ring and ball method (JIS K2531), and more preferably those capable of dissolving in polymerizable monomers.

The toner of the present invention is formed of finer particles than conventional toners, and hence various fluidity improvers can be added thereto to provide developers improved in developing performance, transport performance and so forth. Such a fluidity improver may include fine silica powder, fine titanium oxide powder and fine aluminum oxide powder. The fluidity improver may preferably have a specific surface area of not less than 300 $m^2/g$ as measured by the BET method using nitrogen adsorption, and especially having been disintegrated for the sake of the toner of the present invention. It may preferably be added in an amount ranging from 1 to 50% by weight, depending on the particle diameter of the toner.

The toner of the present invention may preferably have a quantity of triboelectricity of not less than 2 μC/g as an absolute value thereof, generated by friction with an iron powder carrier (EFV200/300; produced by Powderteck Co.). A toner with a quantity of triboelectricity lower than this value can not carry out satisfactory development, making it difficult to form images. FIG. 1 illustrates a device for measuring the quantity of triboelectricity, used in the present invention. A detailed description thereof will be given later.

In the present invention, the toner obtained as described above may be used in a one-component type developer, or a two-component type developer prepared by blending it with a carrier so that the above quantity of triboelectricity necessary for forming images can be obtained when the toner is triboelectrically charged.

The one-component type developer may include magnetic one-component type developers comprising a magnetic toner formed by incorporating the toner particles with a magnetic material, and non-magnetic one-component type developers comprising a nonmagnetic toner formed by incorporating the toner particles with no magnetic material.

Figure 2:
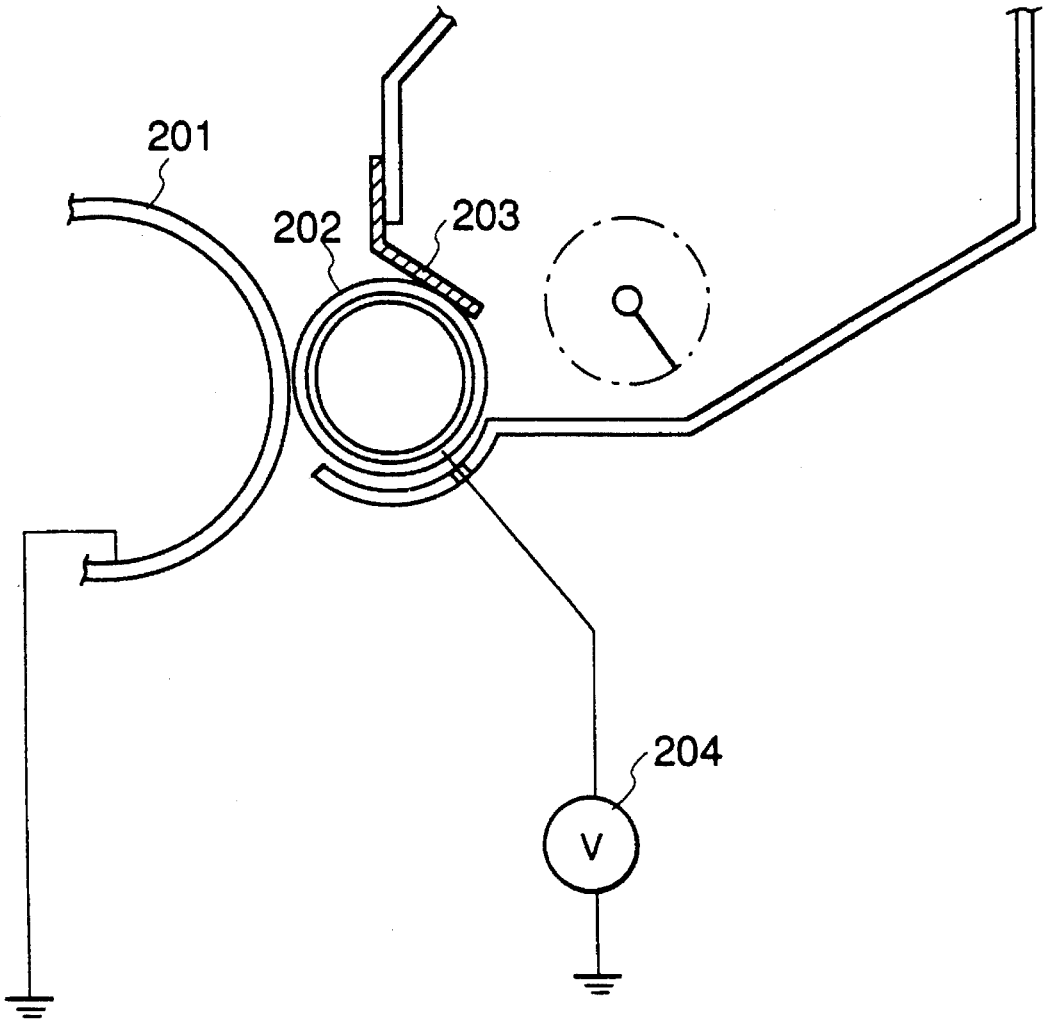
FIG. 2 illustrates a developing apparatus used in non-magnetic one-component type development.

FIG. 2 illustrates a developing apparatus that can be used in non-magnetic one-component type development. In FIG. 2, reference numeral 201 denotes a photosensitive drum; 202, a developing sleeve; and 203, a doctor blade. When the toner of the present invention is applied in this developing apparatus, the surface(s) of the developing sleeve and/or the doctor blade may be polished or blasted, and may also be optionally coated with resin in various ways as described later.

Carrier powder usable in the two-component type developer may specifically include, for example, ferromagnetic metals such as iron powder, cobalt powder and nickel powder; iron oxides such as ferrite, magnetite and hematite; and compounds containing elements showing ferromagnetism such as cobalt and nickel. It may also include magnetic material dispersion type carriers comprising a binder in which the foregoing magnetic material is dispersed.

Such carrier particles may be further subjected to surface coating of various types for the purpose of controlling resistivity, anti-spent properties, impact resistance and triboelectric chargeability. Polymeric compounds used as agents for such surface coating may include various compounds, specifically as exemplified by polystyrene, polymethyl methacrylate, phenol novolak resins, phenol resins, epoxy resins, alkyd resins, melamine resins, cresol novolak resins, a styrene/acrylate copolymer, fluorinated acrylic resins, perfluorocarbon polymers, a silicone/acrylate copolymer, silicone resins, vinyl ether copolymers as exemplified by polymethyl vinyl ether, polyethyl vinyl ether, polybutyl vinyl ether and polyisobutyl vinyl ether, polyvinyl alcohol, polyvinyl acetate, a styrene/butadiene copolymer, an ethylene/vinyl acetate copolymer, vinyl chloride, polyvinyl acetal, cellulose, cellulose acetate, cellulose nitrate, alkylated celluloses, hydroxyalkylated celluloses as exemplified by hydroxymethyl cellulose and hydroxypropyl cellulose, saturated alkyl polyester resins, aromatic polyester resins, polyamide resins, polyacetals, polycarbonate resins, and mixtures of any of these.

The carrier particles used in the present invention may preferably have an average particle diameter ranging from 10 to 100 μm, and more preferably from 10 to 60 μm from the viewpoint of a higher image quality. Carrier particles with a particle diameter smaller than 10 μm tend to cause adhesion of carrier to photosensitive members, and those with a particle diameter larger than 60 μm may make it impossible to achieve a high image quality. In the present invention, number average particle diameter is used as the carrier particle diameter. It is measured by microscopy. More specifically, carrier particles are magnified 10,000 times on an electron microscope, and a photograph of their image is taken. Thereafter, horizontal maximum chord lengths of 300 carrier particles are actually measured and their number average is calculated. The above process may be carried out using an image analyzer.

The toner of the present invention, when blended with the above carrier particles so as to be used as the two-component type developer, may preferably be blended in the developer in a proportion ranging from 0.5% by weight to 10% by weight, depending on the carrier particle diameter.

A method for measuring the quantity of triboelectricity as used in the present invention will be explained in detail. The toner of the present invention and an iron powder carrier (EFV200/300; produced by Powderteck Co.) are blended in a toner concentration of 1% by weight, followed by mixing for 60 seconds using a tumbling mixer. FIG. 1 illustrates an apparatus for measuring the quantity of triboelectricity, used in the present invention. In a measuring container 12 made of a metal at the bottom of which a conducting screen 13 of 500 mesh is provided, a mixture of the toner the quantity of triboelectricity of which is to be measured, and the carrier particles is placed, and the container is covered with a plate 14 made of a metal. The total weight of the measuring container 22 in this state is weighed and is expressed as W1 (g). Next, in a vacuum device 11 (made of an insulating material at least at the portion coming into contact with the measuring container 12), air is evacuated from a vacuum opening 17 and an air-flow control valve 16 is operated to control the pressure indicated by a vacuum indicator 15 to be 250 mmHg. In this state, suction is sufficiently carried out (for about 1 minute) to remove the toner. The potential indicated by a potentiometer 19 at this time is expressed as V (volt). Herein, reference numeral 18 denotes a capacitor, whose capacitance is expressed as C (μF). The total weight of the measuring container after completion of the suction is also weighed and is expressed as W2 (g). The quantity of triboelectricity (μC/g) of the toner is calculated as shown by the following expression.

$$Q(\mu C/g)=(C\times V)\times(W1-W2)^{-1}$$

The present invention can provide an ultrafine-particle toner that can form images reproduced in a high image quality and a high resolution. In particular, the ultrafine-particle toner can be readily and stably obtained on account of the reaction solvent, the types of the polymeric matrix and so forth, and hence the toner can be very highly valuable for its industrial application.

The present invention will be described below by giving Examples. The present invention is by no means limited by the following Examples. The term "part(s)" used in Examples indicates "part(s) by weight" in all occurrences unless particularly noted.

EXAMPLE 1

Into a 1 liter flask provided with a reflux condenser, a thermometer and a nitrogen feeding capillary, a solution comprising the following materials was charged to prepare a polymeric medium.

| | |
|---|---|
| Ethanol | 540 parts |
| n-Hexane | 60 parts |
| Polymethyl vinyl ether (weight average molecular weight: 28,000) | 60 parts |

Next, a monomer composition made up as shown below was charged into the above flask, and was thoroughly mixed.

| | |
|---|---|
| Styrene monomer | 100 parts |
| C.I. Pigment Blue 15:3 | 5.0 parts |
| Di-t-butylsalicylic acid metal compound | 5.0 parts |
| 2,2'-Azobisisobutyronitrile | 1.0 part |

Subsequently, the resulting reaction mixture was refluxed in a stream of nitrogen at 70° C. for 6 hours. After the reaction, the reaction mixture obtained was repeatedly decanted with methyl alcohol, using a centrifugal separator, to wash and remove the polymeric matrix polymethyl vinyl ether. Thereafter, the reaction product obtained was further dried in vacuum to obtain toner particles with an average particle diameter of 1.0 μm. At this time, it was unnecessary to take the step of classification.

Based on 2 parts of the resulting toner particles, 0.4 part of titanium oxide with a BET value of 350 $m^2/g$, having been disintegrated, was mixed using a Henschel mixer to externally add fine titanium oxide powder. Thus, a toner was obtained. To this toner, 98 parts of a ferrite carrier with an average particle diameter of 25 μm, coated with styrene-acrylate resin having preferable triboelectric chargeability, was blended, followed by premixing by means of a tumbling mixer to provide a two-component type developer.

Using this developer, electrostatic images were developed by means of a testing apparatus prepared by modifying a full-color copying machine GLC-500, manufactured by Canon Inc., in which the Vpp, frequency and wave form of the alternating electric field were changed for adaptation to fine-particle development.

Images formed on the photosensitive drum were evaluated under microscopic observation. The images obtained were sharp and cyan images reproduced in a good resolution were obtained.

The images on the photosensitive drum were transferred to a transparent adhesive sheet, and the images were received on a smooth image-receiving paper, followed by fixing on a hot plate. As a result, evaluation on line images with 600 lines gave good results as shown in Table 1, and good images of the same rank as those in offset printing were obtained.

In the present invention, the evaluation on line images with 600 lines was made in the following way. On the photosensitive drum, halftone images were formed by line images with 600 lines, which were divided into 16 gradations of solid white to solid black. Thereafter, the images were transferred to image-receiving paper, and reflection densities of the images were measured. Evaluation on the 600-line images was made according to a gradation plot in which the above reflection densities were plotted with respect to image area ratios, and was made on the basis of their linearity.

EXAMPLES 2 to 5

Toner particles were produced in the same manner as in Example 1 except that solvents made up as shown below were respectively used. Evaluation was made similarly. As a result, images reproduced in a good reproduction were obtained. Table 1 shows production conditions, molecular weights and particle diameters of the toner particles thus produced, and the results of evaluation of image quality.

Example 2: Ethanol/n-hexane=100/0 (weight ratio)
Example 3: Ethanol/n-hexane=40/60 (weight ratio)
Example 4: Ethanol/n-hexane=38/62 (weight ratio)
Example 5: Ethanol/n-hexane=80/20 (weight ratio)

EXAMPLE 6

| | |
|---|---|
| Ethanol | 180 parts |
| n-Hexane | 420 parts |
| Polymethyl vinyl ether (weight average molecular weight: 57,000) | 60 parts |

Toner particles were produced in the same manner as in Example 1 except that the polymeric medium was prepared using the above materials and also polymerization was carried out using a monomer composition made up as shown below.

| | |
|---|---|
| Styrene monomer | 83.2 parts |
| n-Butyl acrylate | 25.6 parts |
| 2,2'-Azobisisobutyronitrile | 1.0 part |
| C.I. Pigment Blue 15:3 | 5.0 parts |

-continued

| | |
|---|---|
| Di-t-butylsalicylic acid metal compound | 5.0 parts |

Using the toner particles thus obtained, a two-component type developer was prepared in the same manner as in Example 1, and evaluation was made similarly. As a result, images reproduced in a good reproduction were obtained. Results obtained are shown in Table 1.

COMPARATIVE EXAMPLE 1

| | |
|---|---|
| Styrene monomer | 100 g |
| C.I. Pigment Blue 15:3 | 5 g |
| Di-t-butylsalicylic acid metal compound | 5 g |

The above materials were heated, dispersed and dissolved, and then a polymerization initiator was dissolved therein. A polymerizable monomer composition was thus prepared. This polymerizable monomer composition was charged in an aqueous medium containing $Ca_3(PO_4)$, and was suspended and dispersed. A suspension thus obtained was reacted. After the reaction was completed, the suspension was cooled, and hydrochloric acid was added to dissolve the $Ca_3(PO_4)$, followed by filtration, washing with water and then drying to obtain toner particles with a weight average particle diameter of 6.5 μm.

Using the toner particles thus obtained, a two-component type developer was prepared in the same manner as in Example 1, and evaluation was made similarly. As a result, though not so much problematic in practical use, the line images with 600 lines were in such a gradation that a gradation curve was obtained in the form where it slightly deviated downward from the straight line at the highlight areas (or the low density parts) and slightly deviated upward from the straight line at the solid areas (or the high density parts). This is presumably due to the relatively large particle diameter of the toner, where minute dots of latent images become blank at the highlight areas and images bulge out of latent images at the solid areas. Results in the present Comparative Example are also shown in Table 1.

EXAMPLE 7

A one-component type developer prepared by externally adding external additives to the toner of Example 6 in the same manner as in Example 1 was loaded in the developing apparatus as shown in FIG. 2, and images were reproduced by one-component type nonmagnetic development to make evaluation on images formed. The image evaluation was made using an apparatus in which the developing assembly for CLC-500 was modified to adapt to non-magnetic development. Here, urethane rubber was used as the doctor blade 203 shown in FIG. 2 and phenol resol was used as a resin layer with which the developing sleeve 202 was covered. As a result of image evaluation, good images were found to have been obtained.

As described above, in the present invention, toner particles with a small particle diameter can be produced in a good efficiency.

On the other hand, as is clear from Comparative Example 1, since in the process for producing a toner by suspension polymerization using an aqueous medium the polymerizable monomers are dispersed in the aqueous medium to form particles while suspended by the aid of a mechanical stirring force, it is difficult for the toner particles with a small particle diameter to be produced in a good efficiency, compared with the process of the present invention.

Moreover, the toners of Examples 1 to 6 give superior results to the toner of Comparative Example 1 in respect of the evaluation on 600-line images.

What is claimed is:

1. A process for producing toner particles, comprising the steps of:

dispersing a monomer composition containing at least a colorant, a charge control agent, or a mixture thereof, and a polymerizable monomer, in free space formed in a polymeric medium comprising a polymer having a weight average molecular weight from 3,000 to 150,000 dissolved in a solvent;

polymerizing the monomer composition dispersed in said free space to obtain toner particles; and removing said toner particles from said polymeric medium, wherein the toner particles have a number average particle

TABLE 1

| | Solvent | | | Tribo.** | Particle diameter | | Image | Particle size distribution | |
|---|---|---|---|---|---|---|---|---|---|
| | Ethanol | n-Hexane | Mw* | (−μC/g) | (μm) | Mw/Mn | evaluation*** | ≦0.3 (% by number) | ≧0.6 (% by number) |
| Example: | | | | | | | | | |
| 1 | 90 | 10 | 420,000 | 25 | 1.0 | 9.57 | AA | 3 | 0 |
| 2 | 100 | 0 | 480,000 | 58 | 0.75 | 6.94 | AA | 8 | 0 |
| 3 | 40 | 60 | 33,000 | 20 | 2.10 | 2.20 | AA | 1.3 | 0.3 |
| 4 | 38 | 62 | 26,000 | 23 | 2.50 | 1.70 | AA | 4.3 | 0.5 |
| 5 | 80 | 20 | 15,000 | 44 | 0.95 | 1.59 | AA | 3.8 | 0.09 |
| 6 | 70 | 30 | 13,000 | 38 | 1.95 | 3.01 | AA | 2.9 | 0 |
| Comparative Example: | | | | | | | | | |
| 1 | Water 100 | | 32,000 | 32 | 6.5 | 3.5 | A | 0 | 75 |

*Weight average molecular weight of resin component in toner particles
**Quantity of triboelectricity
***Line images with 600 lines
Remarks:
Particle size distribution shows values calculated from number distribution.

diameter from 0.5 μm to 5.0 μm, and contain particles with a diameter of 6.0 μm or larger in a proportion of not more than 5% by number.

2. The process according to claim 1, wherein said polymer comprises a compound selected from the group consisting of polystyrene, polymethyl methacrylate, a phenol novolak resin, a cresol novolak resin, a styrene/acrylate copolymer, polymethyl vinyl ether, polyethyl vinyl ether, polybutyl vinyl ether, polyisobutyl vinyl ether, polyvinyl alcohol, polyvinyl acetate, a styrene/butadiene copolymer, an ethylene/vinyl acetate copolymer, polyvinyl chloride, polyvinyl acetal, cellulose, cellulose acetate, cellulose nitrate, an alkylated cellulose, hydroxymethyl cellulose, hydroxypropyl cellulose, a saturated alkylpolyester resin, an aromatic polyester resin, a polyamide resin, a polyacetal and a polycarbonate resin.

3. The process according to claim 1, wherein said polymer has a weight average molecular weight from 8,000 to 80,000.

4. The process according to claim 1, wherein said solvent comprises a solvent selected from the group consisting of a straight-chain or branched aliphatic alcohol, an aliphatic hydrocarbon, an aromatic hydrocarbon, a halogenated hydrocarbon, an ether, a fatty acid, an ester and a sulfur-containing compound.

5. The process according to claim 1, wherein said solvent comprises a solvent selected from the group consisting of methanol, ethanol, 1-propanol, 2-propanol, 1-butanol, 2-butanol, isobutyl alcohol, tertiary butyl alcohol, 1-pentanol, 2-pentanol, 3-pentanol, 2-methyl-1-butanol, isopentyl alcohol, tertiary pentyl alcohol, 1-hexanol, 2-methyl-1-pentanol, 4-methyl-2-pentanol, 2-ethylbutanol, 1-heptanol, 2-heptanol, 3-heptanol, 2-octanol, 2-ethyl-1-hexanol, pentane, 2-methylbutane, n-hexane, cyclohexane, 2-methylpentane, 2,2-dimethylbutane, 2,3-dimethylbutane, heptane, n-octane, isooctane, 2,2,3-trimethylpentane, nonane, decane, cyclopentane, methylcyclopentane, ethylcyclohexane, p-menthane and bicyclohexyl.

6. The process according to claim 1, wherein said polymerizable monomer comprises a monomer selected from the group consisting of styrene, o-methylstyrene, m-methylstyrene, p-methoxylstyrene, p-ethylstyrene, p-tertiarybutylstyrene, acrylic acid, methyl acrylate, ethyl acrylate, n-butyl acrylate, n-propyl acrylate, isobutyl acrylate, octyl acrylate, dodecyl acrylate, 2-ethylhexyl acrylate, stearyl acrylate, 2-chloroethyl acrylate, phenyl acrylate, methacrylic acid, methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, diethylaminoethyl methacrylate, 2-hydroxyethyl acrylate, 2-hydroxyethyl methacrylate, acrylonitrile, methacrylonitrile, acrylamide, methyl vinyl ether, ethyl vinyl ether, propyl vinyl ether, n-butyl ether, isobutyl ether, β-chloroethyl vinyl ether, phenyl vinyl ether, p-methyl phenyl ether, p-chlorophenyl ether, p-bromophenyl ether, p-nitrophenyl vinyl ether, p-methoxyphenyl vinyl ether, 2-vinylpyridine, 3-vinylpyridine, 4-vinylpyridine, N-vinylpyrrolidone, 2-vinylimidazole, N-methyl-2-vinylimidazole, N-vinylimidazole and butadiene.

7. The process according to claim 1, wherein said polymeric medium contains the in a concentration of from 1% by weight to 50% by weight of the reaction solvent.

* * * * *

UNITED STATES PATENT AND TRADEMARK OFFICE

CERTIFICATE OF CORRECTION

PATENT NO. : 5,470,687

DATED : November 28, 1995

INVENTOR(S) : Mayama et al.

It is certified that error appears in the above-indentified patent and that said Letters Patent is hereby corrected as shown below:

COLUMN 1

Line 48, "small sized" should read --small-sized--.

COLUMN 3

Line 1, "of;" should read --of:--.

COLUMN 4

Line 31, "and, an" should read --and an--.

COLUMN 7

Line 47, "triboelectricity," should read --triboelectricity--.

Line 59, "nonmagnetic" should read --non-magnetic--.

COLUMN 8

Line 27, "vinyl chloride," should read --polyvinyl chloride,--.

Line 62, "triboelectricity," should read --triboelectricity--.

Line 65, "toner the" should read --toner, the--.

UNITED STATES PATENT AND TRADEMARK OFFICE

CERTIFICATE OF CORRECTION

PATENT NO. : 5,470,687

DATED : November 28, 1995

INVENTOR(S) : Mayama et_al.

It is certified that error appears in the above-indentified patent and that said Letters Patent is hereby corrected as shown below:

COLUMN 12

Line 6, "nonmagnetic" should read --non-magnetic--.

Line 6, "make" should be deleted.

Line 7, "evaluation on" should read --evaluate the--.

COLUMN 14

Line 30, "the in" should read --the polymer in--.

Line 31, "reaction" should be deleted.

Signed and Sealed this

Eighteenth Day of June, 1996

Bruce Lehman

*Attest:*

BRUCE LEHMAN

*Attesting Officer*

*Commissioner of Patents and Trademarks*